US008549982B2

(12) United States Patent
Troy, Jr. et al.

(10) Patent No.: US 8,549,982 B2
(45) Date of Patent: Oct. 8, 2013

(54) FIREARM CONTROL DEVICES

(76) Inventors: Stephen P. Troy, Jr., Lee, MA (US); David A. Hewes, West Springfield, MA (US); John M. Lopes, West Springfield, MA (US)

( * ) Notice: Subject to any disclaimer, the term of this patent is extended or adjusted under 35 U.S.C. 154(b) by 170 days.

(21) Appl. No.: 13/315,904

(22) Filed: Dec. 9, 2011

(65) Prior Publication Data

US 2012/0192709 A1 Aug. 2, 2012

Related U.S. Application Data

(60) Provisional application No. 61/421,903, filed on Dec. 10, 2010.

(51) Int. Cl.
*F41A 19/33* (2006.01)

(52) U.S. Cl.
USPC ..... 89/132; 89/27.12

(58) Field of Classification Search
USPC ..... 89/132, 142, 148, 27.12
See application file for complete search history.

(56) References Cited

U.S. PATENT DOCUMENTS

| | | | | |
|---|---|---|---|---|
| 4,553,469 | A * | 11/1985 | Atchisson | 89/191.02 |
| 4,693,170 | A * | 9/1987 | Atchisson | 89/149 |
| 4,893,547 | A * | 1/1990 | Atchisson | 89/187.01 |
| 7,775,150 | B2 * | 8/2010 | Hochstrate et al. | 89/193 |
| 7,938,055 | B2 * | 5/2011 | Hochstrate et al. | 89/193 |
| 8,117,958 | B2 * | 2/2012 | Hochstrate et al. | 89/193 |
| 2007/0199435 | A1 * | 8/2007 | Hochstrate et al. | 89/191.02 |
| 2010/0300277 | A1 * | 12/2010 | Hochstrate et al. | 89/179 |
| 2011/0303082 | A1 * | 12/2011 | Hochstrate et al. | 89/193 |
| 2012/0198742 | A1 * | 8/2012 | Troy et al. | 42/6 |
| 2013/0047832 | A1 * | 2/2013 | Hochstrate et al. | 89/191.01 |

* cited by examiner

*Primary Examiner* — Michael David
(74) *Attorney, Agent, or Firm* — Parsons & Goltry; Robert A. Parsons; Michael W. Goltry

(57) ABSTRACT

A fire selector control device for a firearm with a lower receiver that is operable from either side of the firearm. The device includes a selector body designed to fit within the lower receiver and extend between one side of the lower receiver and an opposite side of the lower receiver. The selector body is designed to engage a firing mechanism within the firearm and switch the firing mechanism to any one of a plurality of firing modes. First and second levers are attached to opposite ends of the body to move the body to any one of the plurality of firing options. The first lever is accessible from the exterior of the right side of the lower receiver and the second lever is accessible from the exterior of the left side of the lower receiver.

11 Claims, 8 Drawing Sheets

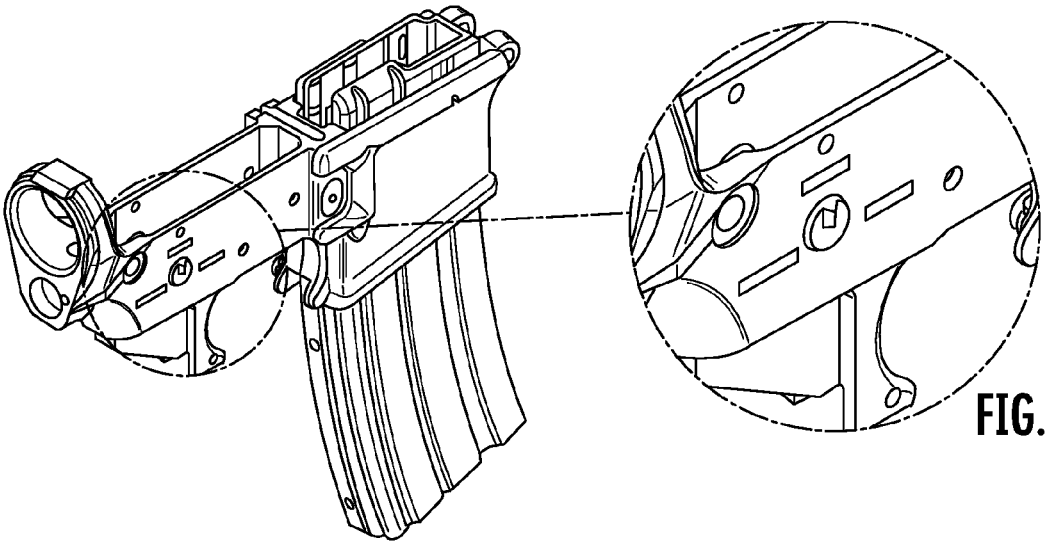
FIG. 6
FIG. 5
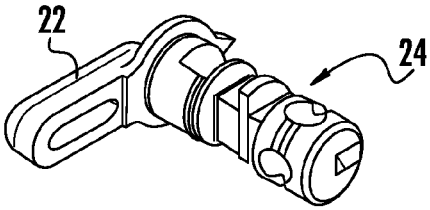
FIG. 7

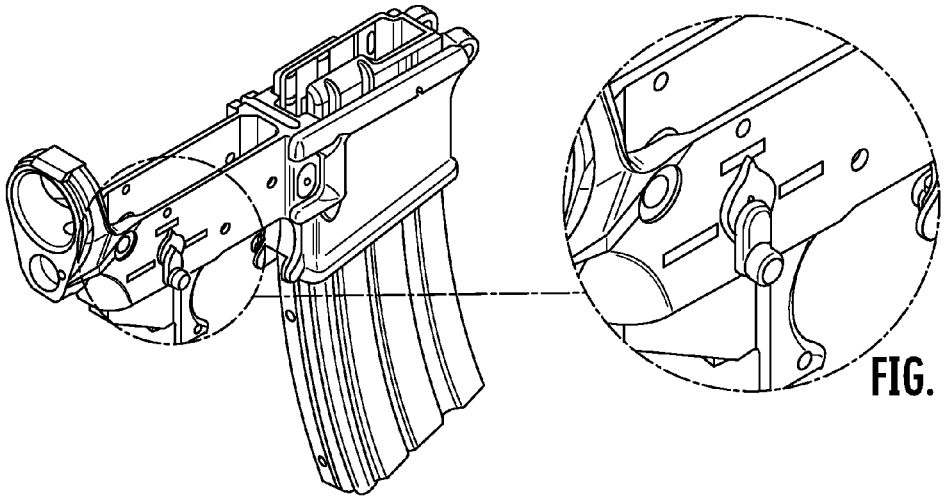
FIG. 14
FIG. 13
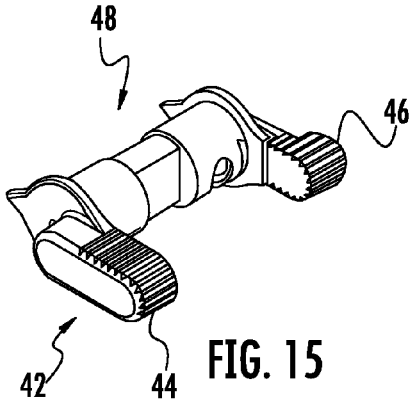
FIG. 15
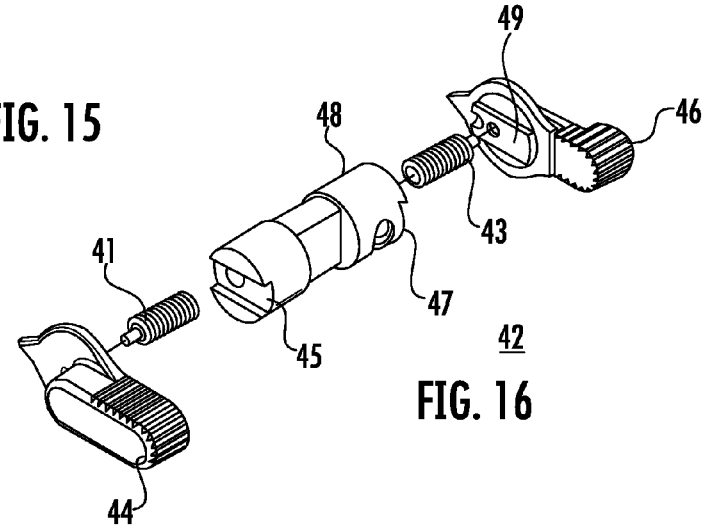
FIG. 16

FIREARM CONTROL DEVICES

CROSS-REFERENCE TO RELATED APPLICATION

This application claims the benefit of U.S. Provisional Patent Application No. 61/421,903, filed 10 Dec. 2010.

FIELD OF THE INVENTION

This invention relates to firearm control devices and more specifically the present invention relates to a fire selector control device for a firearm lower receiver.

BACKGROUND OF THE INVENTION

Hand-held firearms of the auto/semi-auto version require some type of selector capable of switching the firearm between the two modes of operation. In the present firearms of this type the control is positioned only on the left side of the lower receiver for convenience of right-handed operators. However, since only one type or form of this firearm is provided for both left-handed and right-handed users, the selector is inconvenient for left-handed users.

It would be highly advantageous, therefore, to remedy the foregoing and other deficiencies inherent in the prior art.

Accordingly, it is an object of the present invention to provide new and improved firearm control devices.

It is another object of the present invention to provide a new and improved fire selector control device that can be operated from either side of the firearm.

SUMMARY OF THE INVENTION

Briefly, to achieve the desired objects of the instant invention in accordance with a preferred embodiment thereof, a fire selector control device for a firearm with a lower receiver is provided, the control device being operable from either side of the firearm. The control device includes a selector body designed to fit within the lower receiver and extend between one side of the lower receiver and an opposite side of the lower receiver. The selector body is further designed to engage a firing mechanism within the firearm and switch the firing mechanism to any one of a plurality of firing modes. A first lever is attached to one end of the selector body to move the selector body to any one of the plurality of firing options. The first lever is positioned adjacent the outer surface at one side of the lower receiver and accessible from the exterior of the lower receiver. A second lever is attached to an opposite end of the selector body to move the selector body to any one of the plurality of firing options. The second lever is positioned adjacent the outer surface at the opposite side of the lower receiver and accessible from the exterior of the lower receiver. Whereby, the control device is operable from either side of the firearm.

The desired objects of the instant invention are further realized in accordance with a preferred embodiment of a firearm including a lower receiver carrying a firing mechanism changeable between a plurality of selected firing modes of operation and a fire selector control device operable from either side of the firearm. The control device includes a selector body rotatably positioned within the lower receiver and extending between the first side of the lower receiver and the second side of the lower receiver. The selector body engages the firing mechanism within the firearm and is capable of switching the firing mechanism to any one of the plurality of selected firing modes of operation. A first lever is attached to one end of the selector body to rotate the body into any one of the plurality of firing options. The first lever is positioned adjacent the outer surface at one side of the lower receiver and accessible from the exterior of the lower receiver. A second lever is attached to an opposite end of the selector body to rotate the body into any one of the plurality of firing options. The second lever is positioned adjacent the outer surface at the opposite side of the lower receiver and accessible from the exterior of the lower receiver.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which:

FIG. 5 is a more detailed right side perspective view of the lower receiver of the firearm of FIG. 1;

FIG. 6 is an enlarged right side perspective view of the fire control indicator in the lower receiver of the firearm of FIG. 1;

FIG. 7 is an enlarged perspective view of the fire control selector disassembled for the lower receiver of the firearm of FIG. 1;

FIG. 13 is a more detailed right side perspective view of the lower receiver of the firearm of FIG. 8;

FIG. 14 is an enlarged right side perspective view of the fire control selector in the lower receiver of the firearm of FIG. 8;

FIG. 15 is an enlarged perspective view of a semi-automatic fire control selector disassembled for the lower receiver of the firearm of FIG. 8;

FIG. 16 is an enlarged exploded perspective view of the semi-automatic fire control selector of FIG. 15;

DETAILED DESCRIPTION OF A PREFERRED EMBODIMENT

Figure 1:
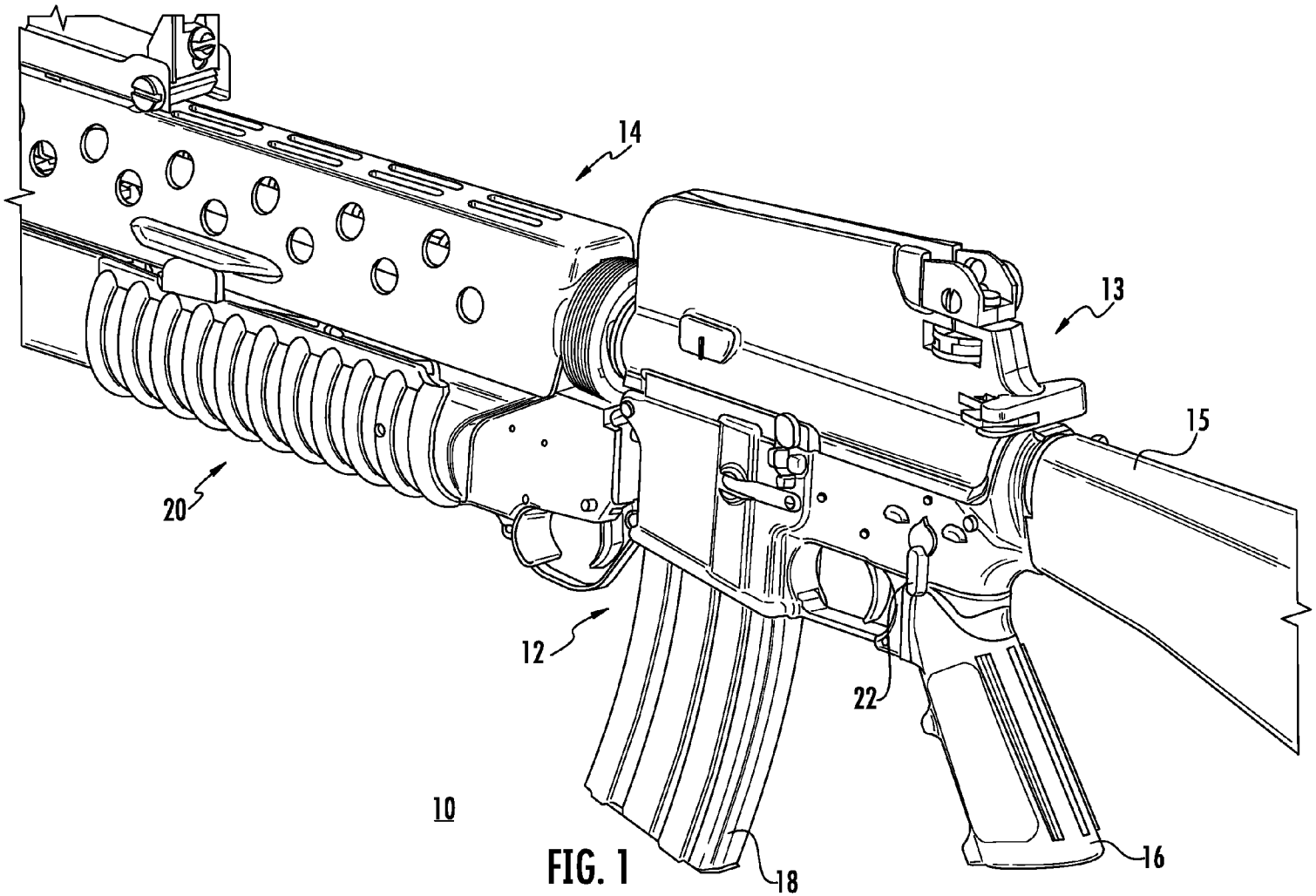
FIG. 1 is a partial left side perspective view of a prior art firearm.

Turning to FIG. 1, a prior art firearm 10 is illustrated. Firearm 10 includes a lower receiver 12 and mating upper receiver 13. Upper receiver 13 includes bolt cartridge insertion and removal mechanism and a firing pin as known in the art. A barrel 14 is engaged in the front end of upper receiver 13 and a stock 15 is affixed to the rear end of lower receiver 12 by some convenient means, such as threading into a rear opening in lower receiver 12. A trigger portion of upper receiver 13 fits into a downwardly directed opening in lower receiver 12 and is integrated with the internal mechanism of upper receiver 13 and lower receiver 12 in a well known manner. A pistol grip 16 is attached to lower receiver 12 in a well known manner. A magazine or clip assembly 18 (including a clip) is inserted into a downwardly directed opening in lower receiver 12 for inserting cartridges into the mechanism within upper receiver 13 in a well known manner. A handguard assembly 20 is affixed to the front end of upper receiver 13 and surrounds and protects a portion of barrel 14.

Figure 2:
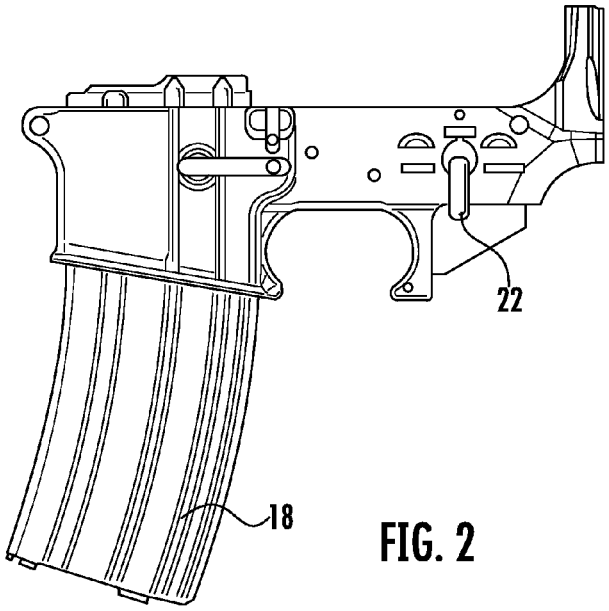
FIG. 2 is a more detailed left side view of the lower receiver of the firearm of FIG. 1.
Figure 3:
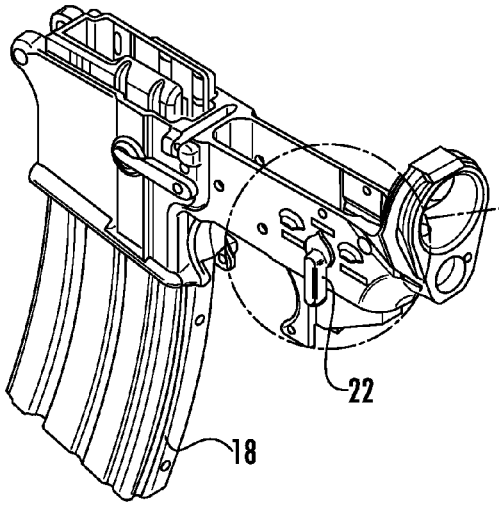
FIG. 3 is a more detailed left side perspective view of the lower receiver of the firearm of FIG. 1.
Figure 4:
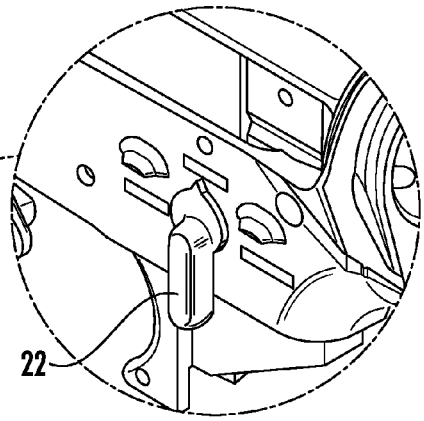
FIG. 4 is an enlarged left side perspective view of the fire control selector in the lower receiver of the firearm of FIG. 1.

Referring additionally to FIGS. 2-4, a fire control selector lever 22 can be seen in more detail. Also, in FIG. 7 fire control lever 22 and an automatic version of the selector body 24 disassembled from lower receiver 12 can be seen. Fire control selector lever 22 and selector body 24 form a three position switch that is designed to change the operation of firearm 10. Essentially, a firing mechanism (not visible) carried by the lower receiver is changeable between a plurality of selected firing modes of operation by the selector body 24. Selector body 24 engages the firing mechanism in a well known manner and will not be elaborated upon in this disclosure. The three operations or positions include: a 'safe' mode when lever 22 is rotated counterclockwise to the horizontal orientation; a semi-automatic mode when lever 22 is in a vertical orientation; and a burst mode of operation when lever 22 is rotated clockwise to the horizontal orientation.

However, as can be seen with further reference to FIGS. 5 and 6, fire control selector lever 22 is only accessible from the left side of firearm 10. A fire control indicator is provided on the right side of firearm 10 to indicate the mode of operation from the right side. As will be appreciated by left handed operators, the provision of fire control selector lever 22 only on the left side of firearm 10 is quite inconvenient.

Figure 8:
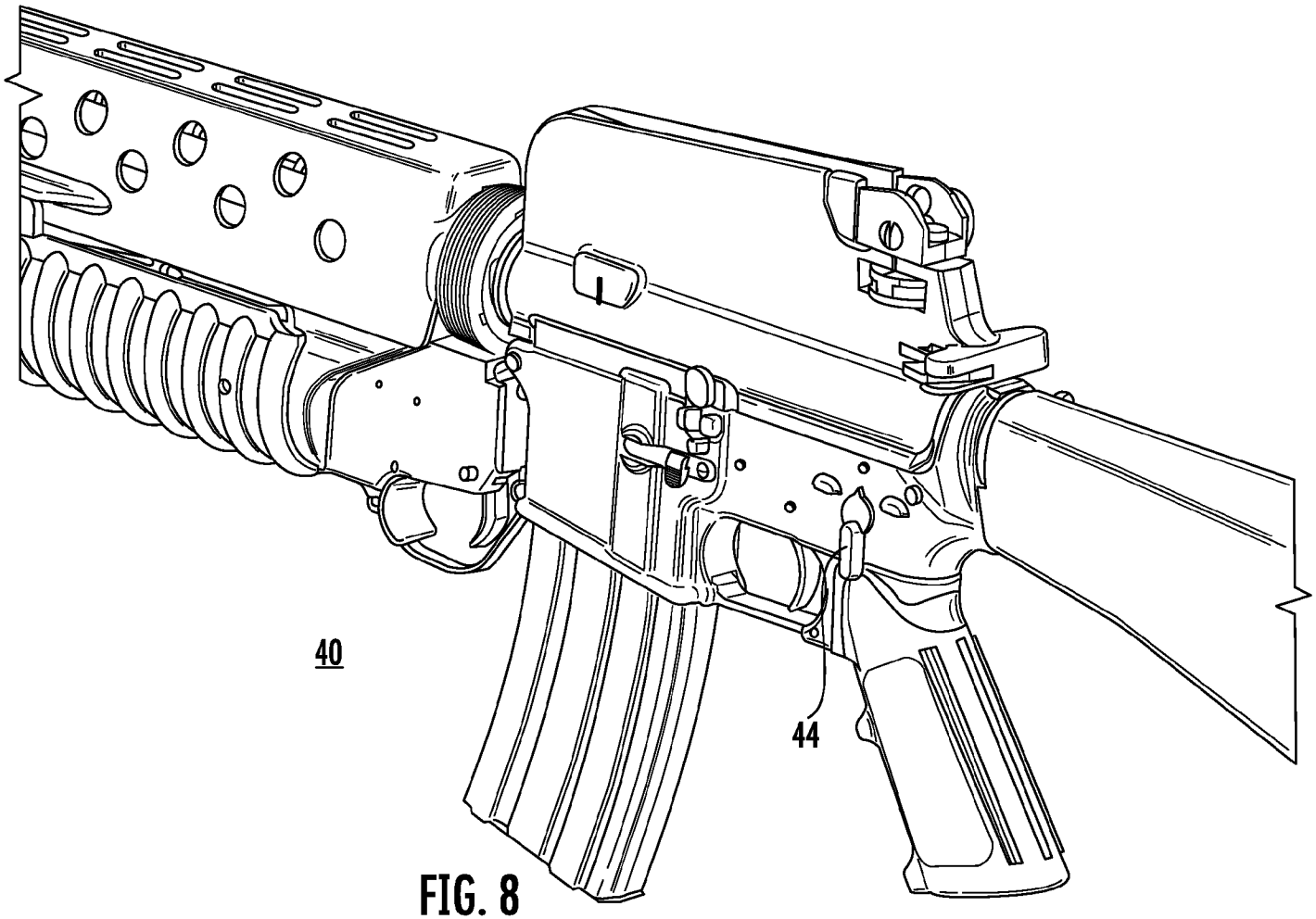
FIG. 8 is a partial left side perspective view of a firearm in accordance with the present invention.
Figure 9:
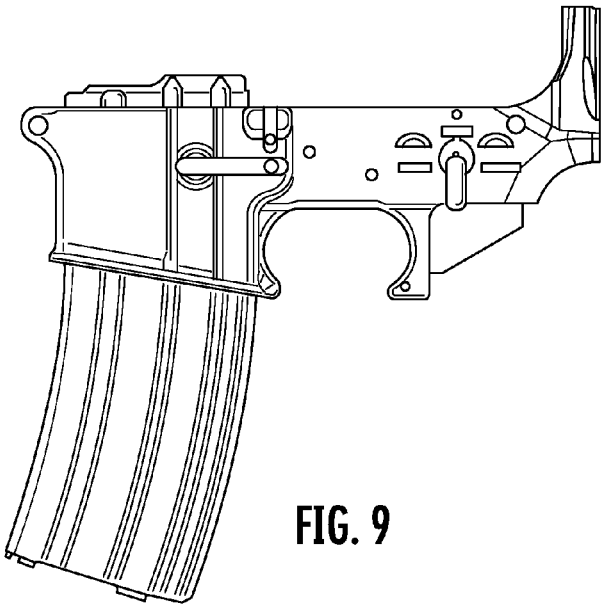
FIG. 9 is a more detailed left side view of the lower receiver of the firearm of FIG. 8.
Figure 10:
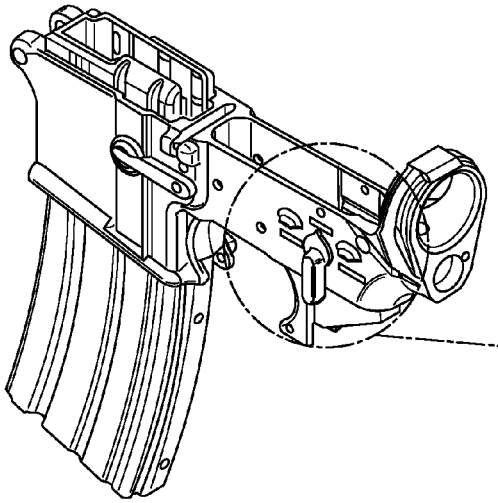
FIG. 10 is a more detailed left side perspective view of the lower receiver of the firearm of FIG. 8.
Figure 11:
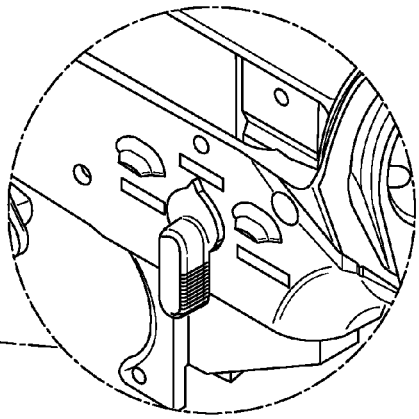
FIG. 11 is an enlarged left side perspective view of the fire control selector in the lower receiver of the firearm of FIG. 1.
Figure 12:
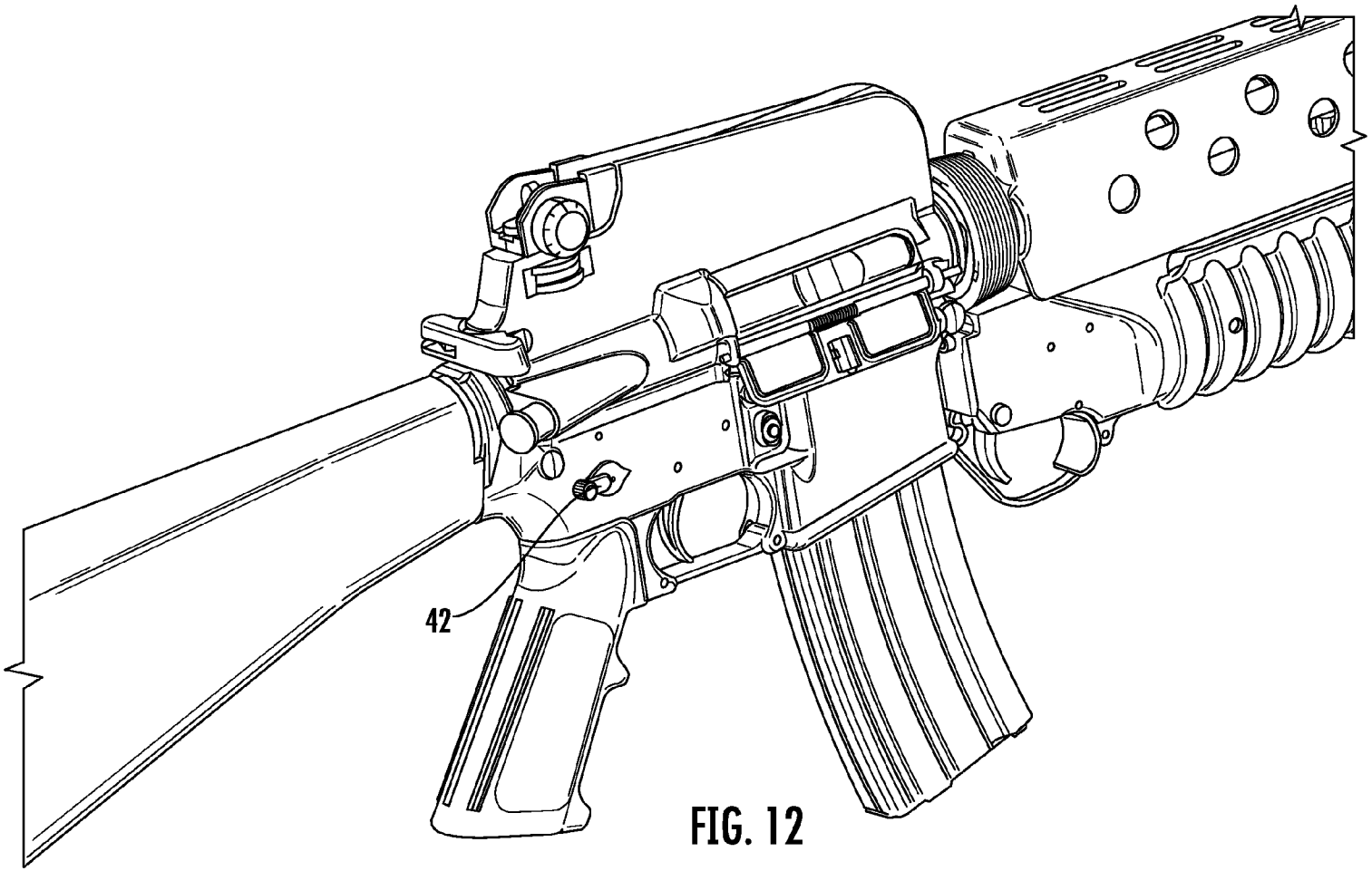
FIG. 12 is a partial right side perspective view of the firearm of FIG. 8 in accordance with the present invention.

Turning now to FIG. 8, a firearm in accordance with the present invention, generally designated 40, is illustrated. Firearm 40 is generally similar to firearm 10 except for a fire control selector, generally designated 42. Referring additionally to FIGS. 9-15, it can be seen that fire control selector 42 includes a control selector lever 44 accessible from the left side of firearm 40, a control selector lever 46 accessible from the right side of firearm 40, and a semi-automatic selector body 48 to which levers 44 and 46 are attached. While the term "lever" is intended to depict any form of device or control that can be used manually to rotate selector body 48 between a plurality of modes of operation, it will be understood that preferably both levers 44 and 46 include an elongated element with a first and second end with both levers 44 and 46 being attached to the selector body adjacent the first end. Also, while an elongated lever as described will provide the operator with a feeling of the position, preferably each of the levers 44 and 46 include a visual position indicator adjacent the first end. The semi-automatic version of firearm 40 is specifically manufactured for civilian sales, since automatic firearms are generally prohibited for civilian use. In this instance control selector levers 44 and 46, in conjunction with selector body 48, form a three position switch that can be moved between a 'safe' mode, a 'single' fire mode, and a 'semi-automatic' mode. Essentially, a firing mechanism (not visible) carried by the lower receiver is changeable between a plurality of selected firing modes of operation by selector body 48. Selector body 48 engages the firing mechanism in a well known manner and will not be elaborated upon in this disclosure.

An exploded view of selector levers 44 and 46 and selector body 48 is illustrated in FIG. 16. Referring specifically to FIG. 16 it can be seen that selector body 48 is provided with a diametrically extending slot 45 on the left end and a diametrically extending slot 47 on the right end. Selector lever 46 is provided with an axially extending ridge 49 on the inwardly directed surface positioned to engage slot 47 for mutual operation or turning. Similarly, selector lever 44 is provided with an axially extending ridge (not visible) on the inwardly directed surface positioned to engage slot 45 for mutual operation or turning. A spring plunger 41 is positioned between selector lever 44 and selector body 48 to ensure a tight fit and continuous engagement between the axially extending ridge on selector lever 44 and slot 45 on selector body 48. A spring plunger 43 is positioned between selector lever 46 and selector body 48 to ensure a tight fit and continuous engagement between axially extending ridge 49 on selector lever 46 and slot 47 on selector body 48.

Figure 17:
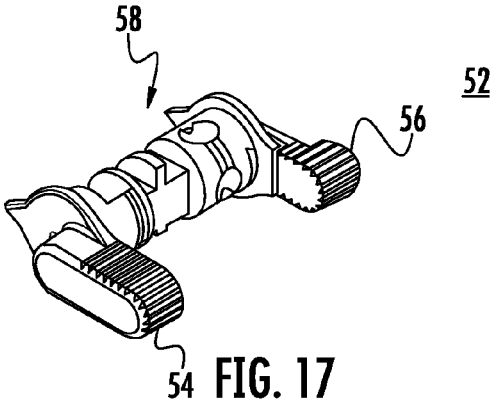
FIG. 17 is an enlarged perspective view of an automatic fire control selector disassembled for the lower receiver of the firearm of FIG. 8.

Turning now to FIG. 17, a fire control selector in accordance with the present invention, generally designated 52, is illustrated. Fire control selector 52 is designed to be alternatively assembled into firearm 40 in the same manner as described above for fire control selector 42. It can be seen that fire control selector 52 includes a control selector lever 54 accessible from the left side of firearm 40, a control selector lever 56 accessible from the right side of firearm 40, and a semi-automatic selector body 58 to which levers 54 and 56 are attached. The automatic version of firearm 40 is specifically manufactured for military sales. In this instance control selector levers 54 and 56, in conjunction with selector body 58, form a three position switch that can be moved between a 'safe' mode, a 'semi-automatic' mode, and a 'burst' or 'automatic' mode of operation.

Figure 18:
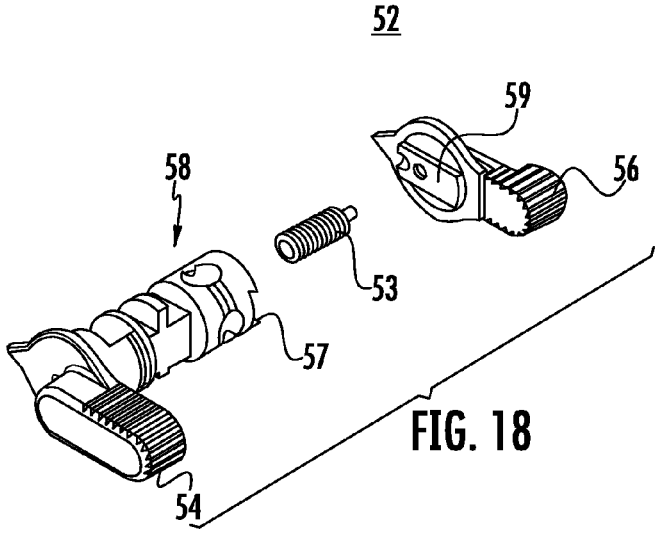
FIG. 18 is an enlarged exploded perspective view of the automatic fire control selector of FIG. 17.

An exploded view of selector levers 54 and 56 and selector body 58 is illustrated in FIG. 18. Referring specifically to FIG. 18 it can be seen that selector lever 54 and selector body 58 are provided as a unit (i.e. fixedly engaged). Also, selector body 58 is provided with a diametrically extending slot 57 on the right end and selector lever 56 is provided with an axially extending ridge 59 on the inwardly directed surface positioned to engage slot 57 for mutual operation or turning. A spring plunger 53 is positioned between selector lever 56 and selector body 58 to ensure a tight fit and continuous engagement between axially extending ridge 59 on selector lever 56 and slot 57 on selector body 58.

Thus, a new and improved firearm control device is illustrated and described. The improved control device is a selector switch that is designed to accommodate setting of the selector switch into any of the three modes of operation from either the left or the right side of the firearm. This is a substantial improvement that facilitates either right handed or left handed operation of the firearm.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A fire selector control device for a firearm with a lower receiver, the control device being operable from either side of the firearm and comprising:

a selector body designed to fit within the lower receiver and extend between one side of the lower receiver and an opposite side of the lower receiver, the selector body being further designed to engage a firing mechanism within the firearm and switch the firing mechanism to any one of a plurality of firing modes;

a first lever attached to one end of the selector body to move the selector body to any one of the plurality of firing modes, the first lever being positioned adjacent the outer surface at one side of the lower receiver and accessible from the exterior of the lower receiver; and a second lever attached to an opposite end of the selector body to move the selector body to any one of the plurality of firing modes, the second lever being positioned adjacent the outer surface at the opposite side of the lower receiver and accessible from the exterior of the lower receiver.

2. A fire selector control device as claimed in claim 1 wherein the first lever is an elongated element with a first and second end, the first lever being attached to the selector body adjacent the first end and including a visual position indicator adjacent the first end.

3. A fire selector control device as claimed in claim 1 wherein the second lever is an elongated element with a first and second end, the second lever being attached to the selector body adjacent the first end and including a visual position indicator adjacent the first end.

4. A fire selector control device as claimed in claim 1 wherein the plurality of firing modes includes a 'safe' mode, a 'single' fire mode, and a 'semi-automatic' mode of operation.

5. A fire selector control device as claimed in claim 1 wherein the plurality of firing modes includes a 'safe' mode, a 'semi-automatic' mode, and a 'burst' or 'automatic' mode of operation.

6. A fire selector control device for a firearm with a lower receiver, the control device being operable from either the right side or the left side of the firearm and comprising:

a selector body designed to fit within the lower receiver and extend from one side of the lower receiver to an opposite side of the lower receiver, the selector body being further designed to engage a firing mechanism within the firearm and switch the firing mechanism to any one of a plurality of firing modes;

a first lever attached to one end of the selector body to move the selector body to any one of the plurality of firing modes, the first lever being positioned adjacent the outer surface at the right side of the lower receiver and accessible from the exterior at the right side of the lower receiver, the first lever being an elongated element with a first and second end, the first lever being attached to the selector body adjacent the first end and including a visual position indicator adjacent the first end; and a second lever attached to an opposite end of the selector body to move the selector body to any one of the plurality of firing modes, the second lever being positioned adjacent the outer surface at the left side of the lower receiver and accessible from the exterior at the left side of the lower receiver, the second lever being an elongated element with a first and second end, the second lever being attached to the selector body adjacent the first end and including a visual position indicator adjacent the first end.

7. A firearm comprising:

a lower receiver carrying a firing mechanism changeable between a plurality of selected firing modes of operation, the lower receiver including a first side and an opposed second side; and a fire selector control device operable from either the first side or the second side of the firearm, the control device comprising:

a selector body rotatably positioned within the lower receiver and extending between the first side of the lower receiver and the second side of the lower receiver, the selector body engaging the firing mechanism within the firearm and switching the firing mechanism to any one of the plurality of selected firing modes of operation;

a first lever attached to one end of the selector body to rotate the body into any one of the plurality of firing modes, the first lever being positioned adjacent the outer surface at the first side of the lower receiver and accessible from the exterior of the first side of the lower receiver; and a second lever attached to an opposite end of the selector body to rotate the body into any one of the plurality of firing options, the second lever being positioned adjacent the outer surface at the second side of the lower receiver and accessible from the exterior of the second side of the lower receiver, whereby, the fire selector control device is operable from either side of the firearm.

8. A firearm as claimed in claim 7 wherein the first lever is an elongated element with a first and second end, the first lever being attached to the selector body adjacent the first end and including a visual position indicator adjacent the first end.

9. A firearm as claimed in claim 7 wherein the second lever is an elongated element with a first and second end, the second lever being attached to the selector body adjacent the first end and including a visual position indicator adjacent the first end.

10. A firearm as claimed in claim 7 wherein the plurality of firing modes includes a 'safe' mode, a 'single' fire mode, and a 'semi-automatic' mode of operation.

11. A firearm as claimed in claim 7 wherein the plurality of firing modes includes a 'safe' mode, a 'semi-automatic' mode, and a 'burst' or 'automatic' mode of operation.

* * * * *